United States Patent [19]

Nagahori

[11] 4,378,741

[45] Apr. 5, 1983

[54] INTERFACED CONVEYOR SYSTEMS AND DRIVERLESS VEHICLE FOR USE THEREIN

[75] Inventor: Katsuhiro Nagahori, Chiba, Japan

[73] Assignee: SI Handling Systems, Inc., Easton, Pa.

[21] Appl. No.: 226,586

[22] Filed: Jan. 21, 1981

[30] Foreign Application Priority Data

Jan. 21, 1980 [JP] Japan ..... 55-5524

[51] Int. Cl.[3] ..... B61B 13/12; B61K 1/00

[52] U.S. Cl. ..... 104/18; 104/166; 198/472; 414/334

[58] Field of Search ..... 104/18, 20, 165, 166; 198/472; 414/334

[56] References Cited

U.S. PATENT DOCUMENTS 986,484 3/1911 Miller ..... 414/334

1,247,805 11/1917 Febre ..... 414/334

3,190,477 6/1965 Ewers ..... 104/18 X 3,734,025 5/1973 Shoemaker ..... 104/18 X 3,858,707 1/1975 Block et al. ..... 104/166 X

*Primary Examiner*—Randolph Reese

*Attorney, Agent, or Firm*—Seidel, Gonda, Goldhammer & Panitch

[57] ABSTRACT

A conveyor system such as one having chain propelled driverless vehicles is interfaced with a conveyor system such as one having rotating shafts propelling a driverless vehicle. The last mentioned driverless vehicle is provided with a contact arm which extends transversely of its vehicle and is selectively operated so as to cause both vehicles to move at the same speed. While both vehicles are moving at the same speed, one or more events may take place such as transferring goods from one vehicle to another on the fly.

9 Claims, 3 Drawing Figures

INTERFACED CONVEYOR SYSTEMS AND DRIVERLESS VEHICLE FOR USE THEREIN

BACKGROUND

Conveyor systems wherein driverless vehicles are propelled by a chain or the like are known. For example, see U.S. Pat. No. 3,103,895. It is known to transfer a load off such a vehicle on the fly, that is without stopping the vehicle. For example, see U.S. Pat. No. 4,005,787. Conveyor systems wherein a driverless vehicle is propelled by a rotating shaft in contact with a drive wheel on the vehicle are known. For example, see U.S. Pat. No. 3,356,040.

At some locations, both types of systems are utilized. The present invention is directed to a solution of the problem of how to interface the two different types of conveyor systems so that vehicles moving along parallel juxtaposed portions of the conveyor systems may be caused to move at the same speed.

SUMMARY OF THE INVENTION

The present invention is directed to interfaced systems and a vehicle for use therein. As pertains to the last mentioned vehicle, it includes a base mounted on support wheels together with at least one drive wheel assembly. The drive wheel assembly is pivotable about an upright axis on the base between a drive position and an accummulation position. An arm is connected to the assembly and adapted to move the drive wheel assembly toward its accummulation position upon contact with an object in its path. A means is provided for moving the arm between an extended position wherein the arm extends transversely beyond the side edge of the base and a retracted position.

In connection with the interfaced conveyor systems, they are preferably different with the first system having driverless vehicles propelled by a cable of chain and with the second system having driverless vehicles propelled along tracks by contact between a drive wheel and a rotating shaft. Each such drive wheel is pivotable about an upright axis between a drive position and an accummulation position to thereby vary the speed of the vehicles of the second system. The vehicles of the second system have means thereon selectively movable to an extended position for contact with vehicles of the first system. As a result two vehicles of the respective systems moving along adjacent portions of the systems will move in the same direction at the same speed.

It is an object of the present invention to provide an interface between two different types of conveyor systems so that driverless vehicles of the respective systems will move along adjacent portions of the systems in the same direction at the same speed.

It is another object of the present invention to provide a novel driverless vehicle having means thereon for selectively moving a contact arm in a transverse direction between extended and retracted positions.

Other objects and advantages will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
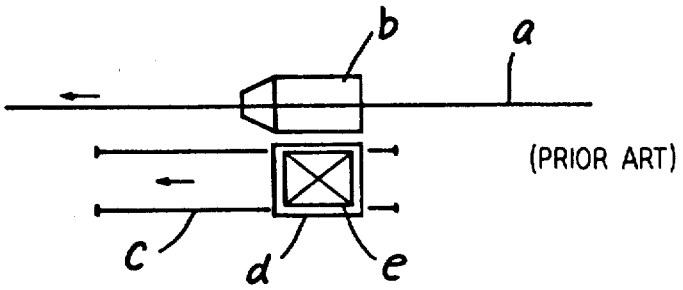
FIG. 1 is a diagramatic top plan view of two different prior art conveyor systems having a portion which are adjacent and parallel.

Referring to FIG. 1, there is shown a driverless vehicle (b) being propelled from right to left by a chain or cable designated (a). Alongside a portion of that conveyor system, there is shown a portion of another conveyor system which includes a driverless vehicle (d) moving from right to left on the tracks (c). Vehicle (d) is provided with a load (e). There is no interface between the systems.

Figure 3:
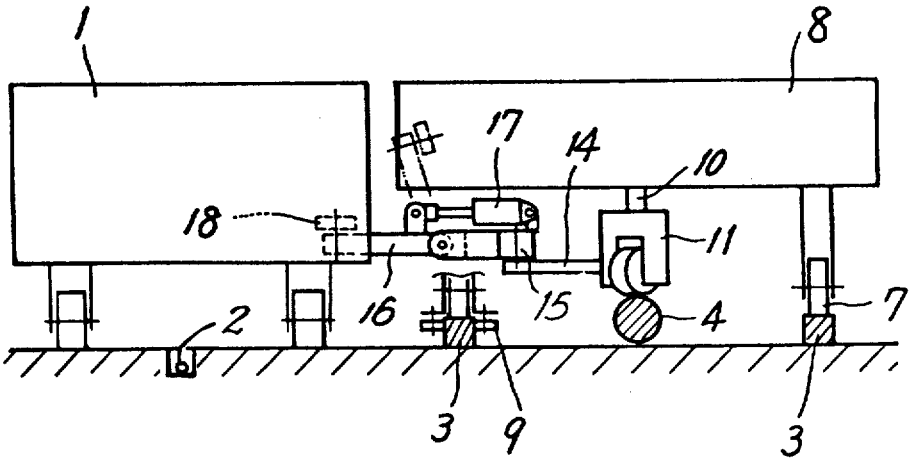
FIG. 3 is a front elevation view of the vehicles shown in FIG. 2.
Figure 2:
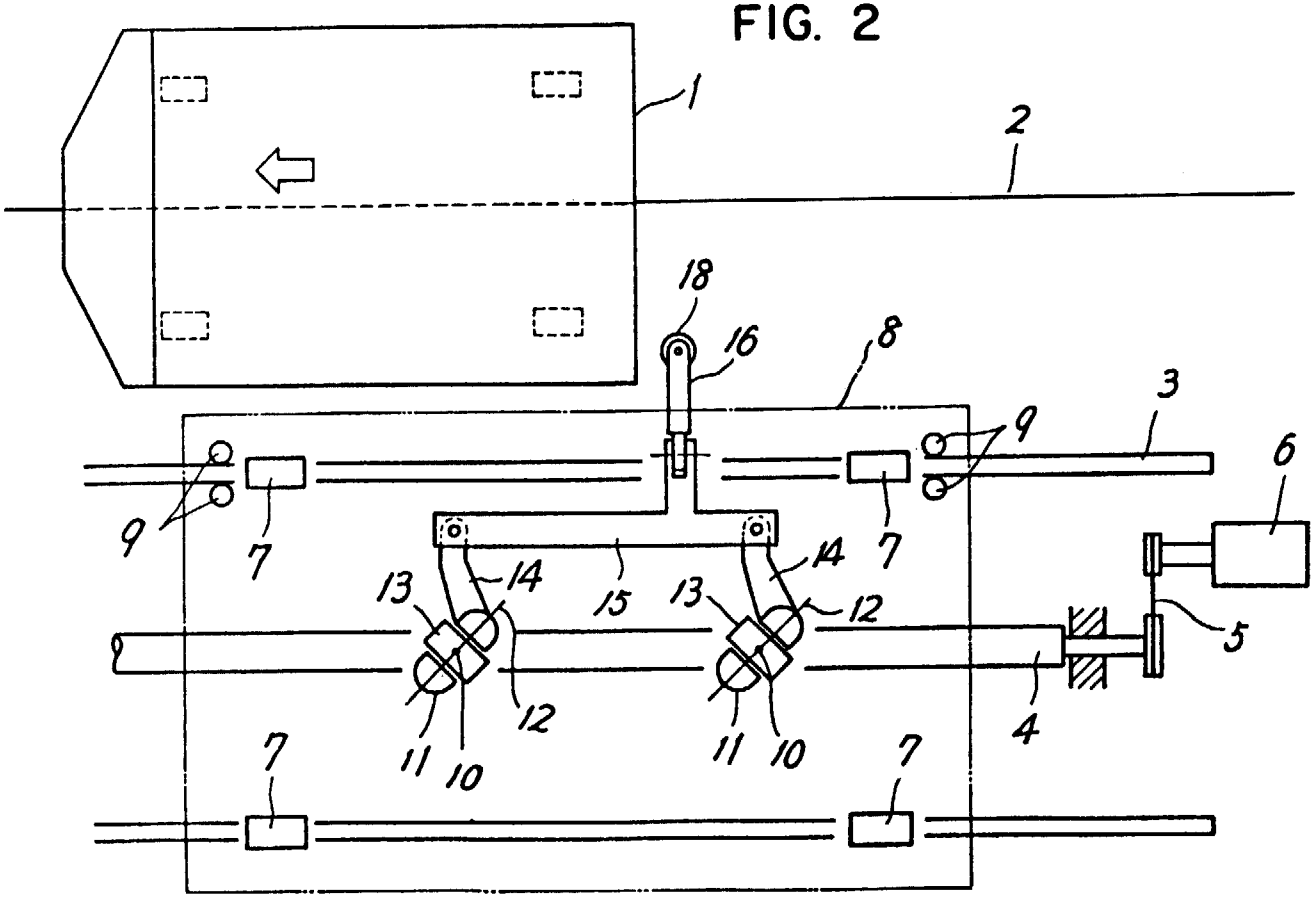
FIG. 2 is a diagramatic plan view similar to FIG. 1 but on an enlarged scale and showing the present invention.

Referring to FIGS. 2 and 3 of the present invention, the parallel portions of the systems are reproduced as shown in FIG. 1. The driverless vehicle 1 is propelled from right to left in FIG. 2 by a conveyor chain or cable 2. Moving in the same direction, there is provided a driverless vehicle 8 having support wheels 7 guided by parallel tracks 3. Along one side of the vehicle 8, there is provided guide wheels 9 so as to maintain the vehicle on the tracks 3. Vehicle 8 is propelled from right to left in FIG. 2 by contact between a rotating shaft 4 and drive wheels. The shaft 4 is between the tracks 3 and is driven by a motor 6 and belt, chain or the like 5 so as to cause the shaft 4 to rotate about its longitudinal axis.

The vehicle 8 has at least one drive wheel in frictional contact with the drive shaft 4. As illustrated in FIG. 2, in order to handle heavier loads, the vehicle 8 is provided with a pair of drive wheels 13. The drive wheels 13 are mounted on a support 11 so that they may rotate about horizontal axes 12 and pivot with their supports about vertical axes 10. Each of the supports 11 is coupled by way of a link 14 to a connecting rod 15.

Connecting rod 15 is parallel to the tracks 3 and moves with the supports 11 as they pivot about the vertical axes 10. In FIG. 2, the drive wheels 13 are in their drive position. When the axes 12 are parallel to the longitudinal axis of the shaft 4, vehicle 8 will be in an accummulation position where there is little or no forward thrust on the vehicle 8. Connecting rod 15 has a transversely disposed extension to which is movably mounted a contact arm 16. In the preferred embodiment as shown, arm 16 is pivotably connected to the extension for movement about a horizontal axis parallel to the longitudinal axis of shaft 4.

The contact arm 16 at its free end terminates in a cam follower 18 which rotates about a vertical axis. Arm 16 is moved from an extended position as shown in solid lines in FIG. 3 to a retracted position as shown in phantom lines in FIG. 3 by means of a motor 17. Motor 17 may assume a wide variety of configurations and/or types. For example, motor 17 may be a solenoid whose plunger is a rod pivotably connected to contact arm 16. Power to activate motor 17 when it is in the form of a solenoid may be coupled thereto by a bus bar (not shown) along a portion of the tracks or at any of the station stops for vehicle 8 by brushes and/or slip rings which engage contacts not shown on the vehicle 8. The contact arm 16 extends for a sufficient distance transversely of the vehicle 8 so that cam follower 18 may engage and push against a trailing end of the vehicle 1.

When cam follower 18 contacts the trailing end of vehicle 1, arm 16 will move rearwardly, that is from left to right in FIG. 2. In doing so, links 14 will pivot the supports 11 about the axes 10 to thereby move the drive wheels 13 toward an accummulation position until both vehicles are moving together at the same speed. Thereafter, a number of production controls may be affected. For example, a load such as load (e) may be transferred from vehicle 8 to vehicle 1 or visa versa as taught by U.S. Pat. No. 4,005,587. Another control which may be attained is the desirability of having both vehicles arrive at a station simultaneously.

As described above and shown in the drawings, the structure for interfacing the two systems so that one vehicle of one system attains the same speed of one vehicle of the other system as they are moving in the same direction along parallel portions of the systems has been attained in a simple, inexpensive, and reliable manner. Instead of pivoting, the contact arm 16 could reciprocate between its extended and retracted positions.

The present invention may be embodied in other specific forms without departing from the spirit or essential attributes thereof and, accordingly, reference should be made to the appended claims, rather than to the foregoing specification, as indicating the scope of the invention.

I claim:

1. A driverless vehicle comprising a base mounted on support wheels, at least one drive wheel assembly pivotable about an upright axis on said base between a drive position and an accumulation position, means for selectively enabling said base to push another vehicle in the same direction, said means including an arm connected to said assembly and adapted to move the drive wheel assembly toward its accumulation position upon contact with another vehicle, and means for moving said contact arm between an extended position wherein the arm extends transversely beyond the side edge of the base and a retracted position.

2. A vehicle in accordance with claim 1 wherein said last mentioned means is a motor supported by the base.

3. A vehicle in accordance with claim 1 wherein said contact arm is supported by pivotable movement about a horizontal axis on a connecting rod extending between a pair of said drive wheels, said arm being horizontally disposed in its operative position, said last mentioned means being arranged to move the arm and pivot it upwardly to an inoperative retracted position.

4. A driverless vehicle in accordance with claim 1 wherein said arm is connected to said assembly at an elevation above the elevation of said support wheels.

5. A driverless vehicle comprising a base mounted on support wheels, at least one drive wheel assembly pivotable about an upright axis on said base between a drive position and an accumulation position, means for pushing another vehicle by interfacing said base with another vehicle moving in the same direction, said means including a contact arm movably supported by said base for movement between an extended position wherein the arm extends transversely beyond a side edge of the base and a retracted inoperative position.

6. Apparatus comprising a pair of interfaced conveyor systems of different types comprising a first system wherein driverless vehicles are propelled by a chain or cable and a second system wherein driverless vehicles are propelled along tracks by contact between a drive wheel and a rotating shaft, the drive wheels on the vehicles of the second system being pivotable about an upright axis between a drive position and an accumulation position to thereby vary the speed of the vehicles of the second system, the vehicles of one of said systems having selectively movable pushing means thereon for pushing contact with a vehicle of the other system so that two vehicles of the respective systems moving along adjacent portions of the systems move in the same direction at the same speed.

7. Apparatus in accordance with claim 6 wherein said pushing means are on the vehicles of the second system.

8. Apparatus in accordance with claim 7 wherein said movable means on the vehicles of the second system includes an arm movable between an extended position transverse of the vehicle of the second system and a retracted inoperative position, said arm being connected to the drive wheel support on its vehicle.

9. Apparatus in accordance with claim 7 wherein the pushing means includes an arm and a motor for moving the arm between a horizontal pushing position and a retracted inoperative position.

* * * * *